US007331070B1

(12) United States Patent
Al-Anezi

(10) Patent No.: US 7,331,070 B1
(45) Date of Patent: Feb. 19, 2008

(54) PORTABLE SINK FOR THE HANDICAPPED

(76) Inventor: Aref Ghareeb Al-Anezi, P.O. Box - 25263, Safat, 13113 (KW)

( * ) Notice: Subject to any disclaimer, the term of this patent is extended or adjusted under 35 U.S.C. 154(b) by 0 days.

(21) Appl. No.: 11/676,629

(22) Filed: Feb. 20, 2007

(51) Int. Cl.
*A47K 1/04* (2006.01)

(52) U.S. Cl. ..... 4/619; 4/640; 4/641; 4/644; 4/650

(58) Field of Classification Search ..... 4/619, 4/620, 624–627, 639–641, 643, 644, 650
See application file for complete search history.

(56) References Cited

U.S. PATENT DOCUMENTS 2,594,938 A * 4/1952 Leavitt ..... 4/626
5,301,376 A * 4/1994 Herbert ..... 4/626
6,161,228 A * 12/2000 Wietecha ..... 4/625
6,836,910 B2 * 1/2005 Cawthon ..... 4/650

* cited by examiner

*Primary Examiner*—Tuan Nguyen
(74) *Attorney, Agent, or Firm*—Lowe Hauptman Ham & Berner, LLP

(57) ABSTRACT

A portable sink includes first and second storage tanks for storing clean and dirty water respectively and a concave basin between the two tanks. The sink also includes a plastic base member that supports the clean water tank above and to one side of the base and the second tank below the concave basin. A normally closed one-way depressible valve connects the basin and the second storage tank for allowing water to drain into the second tank by gravity and from preventing dirty water from being returned to the basin. The valve also includes a circular plug with an upwardly extending skirt and a coil spring within the skirt for biasing the valve into a closed position.

12 Claims, 3 Drawing Sheets

PORTABLE SINK FOR THE HANDICAPPED

FIELD OF THE INVENTION

This invention relates to a portable sink assembly for the handicapped and more particularly to a portable sink assembly that includes separate compartments for clean and spent water.

BACKGROUND FOR THE INVENTION

Portable sink apparatus are known and have been in use for many years. For example a Herbert U.S. Pat. No. 5,301,376 discloses a portable sink that is arranged for ease of transportation and storage. The sink includes a central housing having respective lower and upper housings positioned on opposite sides of the central housing. As disclosed the upper housing includes a fluid reservoir structure arranged for orthogonal orientation relative to the central housing, with a faucet member permitting fluid flow upon pivoting of the faucet relative to a floor cavity within the upper housing floor. A lower housing includes an upper housing reservoir in communication with a sink within the central housing for storage and subsequent disposal of fluid within the lower housing.

A further approach to portable sinks is disclosed in a Wright U.S. Pat. No. 5,313,676. The Wright patent discloses a portable sink having foldable legs and a pump member to receive water from available water supplies and to direct such water to a faucet and to an underlying sink. The sink is arranged for unfolding of the legs and a wing plate for ease of positioning the table relative to an underlying support surface.

A more recent approach to portable sinks is disclosed in a Patterson U.S. Pat. No. 6,959,460. The Patterson patent discloses a portable wash basin that includes a sink for receiving fresh water for permitting a user to wash. The sink defines an open top for the reception of fresh water so that the user is permitted to wash therein. A container is disposed adjacent to the sink for containing the fresh water and a pump is operably connected to the container for pumping the fresh water from the container into the sink. A lid is secured to the sink such that when the lid is disposed in an open position access to the sink by the user is permitted and when the lid is disposed in a closed position, the lid covers the sink.

Notwithstanding the above, it is presently believed that there is a need and a potential commercial market for an improved portable sink for the handicapped in accordance with the present invention. There should be a market for such sinks because they have a supply of clean water, a storage tank for dirty water and a wash basin. The sinks incorporate a gravity flow system that eliminates the need for a pump and has a depressible one-way valve that prevents dirty water from entering the wash basin. Further, the portable sinks in accordance with the present invention are of durable construction and are relatively inexpensive to manufacture. The sinks also include foldable legs and are relatively compact for storage and transportation that facilitates dumping the dirty water and refilling the clean water tank. These and other advantages of the invention will become obvious from the following description of the invention.

BRIEF SUMMARY OF THE INVENTION

In essence, the present invention contemplates a portable sink assembly including a base member and a plurality of foldable legs for supporting the base member above a surface when in a first position and foldable flat against the base member for storage and transport. The sink also includes a first storage tank for containing a supply of clean water, a concave basin and a second storage tank for receiving dirty water from the concave basin. The base member also includes a support means for supporting the first storage tank above the level of the concave basin and means for supporting the second storage tank below the level of the concave basin with a lower part of the concave basin in contact with a top portion of the second storage tank. A fluid passage is provided between the lower part of the concave basin and the upper part of the second storage tank with a normally closed one-way depressible valve connecting the lower part of the basin and the second storage tank. This valve prevents water from the second storage tank from flowing back into the concave basin. A separate depressor constructed and arranged for manually depressing the valve is also provided for opening the valve to drain the dirty water from the basin and into the second storage tank. Finally, a cover fits over the base member with means for releaseably fastening the cover to the base member.

A preferred embodiment of the invention includes a rotatable faucet that swings out from the first storage tank over the basin for directing clean water into the basin as well as a water level indicator on one side of the base member.

The invention will now be described in connection with the accompanying drawings wherein like reference numerals have been used to indicate like parts.

DESCRIPTION OF THE PREFERRED EMBODIMENTS OF THE INVENTION

Figure 1:
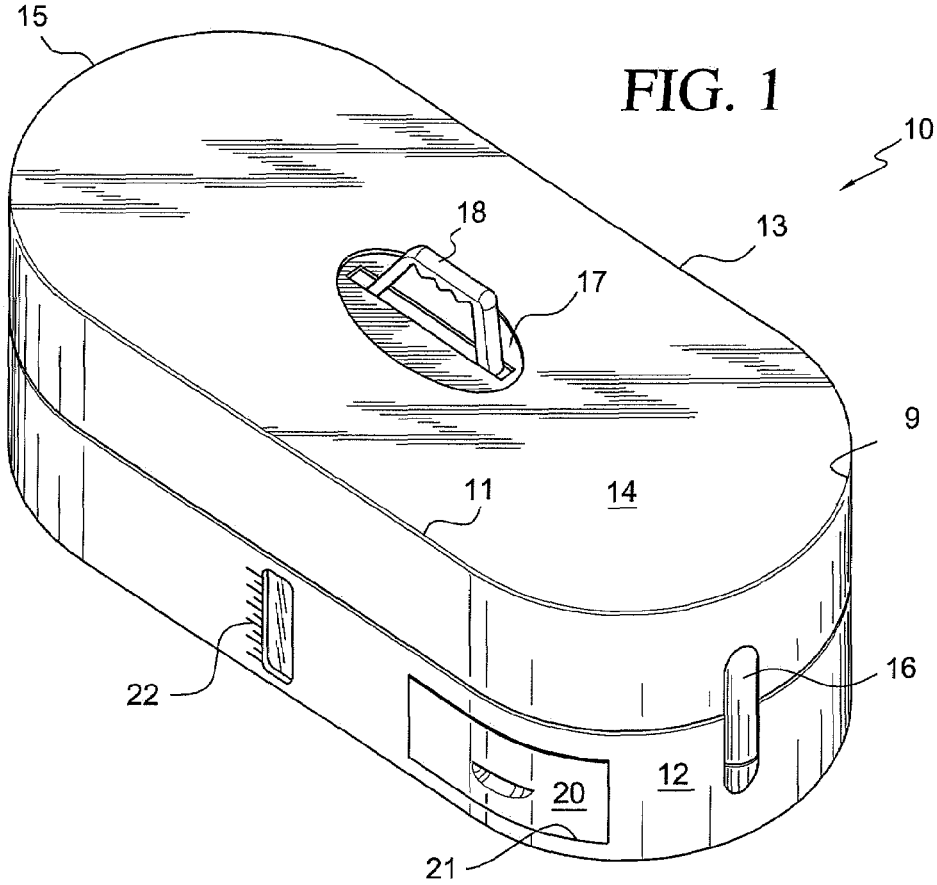
FIG. 1 is a perspective view of a portable sink in accordance with the present invention wherein the portable sink is shown with its cover in a closed position.

A portable sink assemble for the handicapped in accordance with the present invention will now be described in connection with FIGS. 1-3. As shown in FIG. 1 the portable sink assembly 10 includes a base member 12 and cover 14 which define a generally oval-like shape having two parallel sides 11 and 13 and semi-circular ends 9 and 15. In FIG. 1, the cover 14 is shown in a closed position as used for storage or transport and encloses the operable elements of the portable sink 10. The cover 14 fits tightly over the base member 12 and is held in place by a pair of conventional latch assemblies 16 (only one shown). The latch assembly 16 may be of any conventional design such as one having a U-shaped latch that fits over a lower shoulder member and snaps in place to pull the cover down into a tightly engaged contact with the base member 12. The cover 14 also includes a conventional foldable handle 18 in a recessed portion 17 in a central portion of an upper flat surface of the cover 14.

The base member 12 includes a drawer 20 that fits within a drawer opening 21 in the front right side of the base member 12 for storing towels or the like. In a preferred embodiment of the invention the base member 12 also includes a liquid level gage 22 in a front surface of the base member that indicates the level of dirty water in a storage tank. This gage is used when the tank used for dirty water is larger than a tank for clean water. In this arrangement, the tank for clean water is readily removable for refilling without moving the entire assembly for servicing i.e. emptying the dirty water and refilling a first storage tank with clean water.

Figure 2:
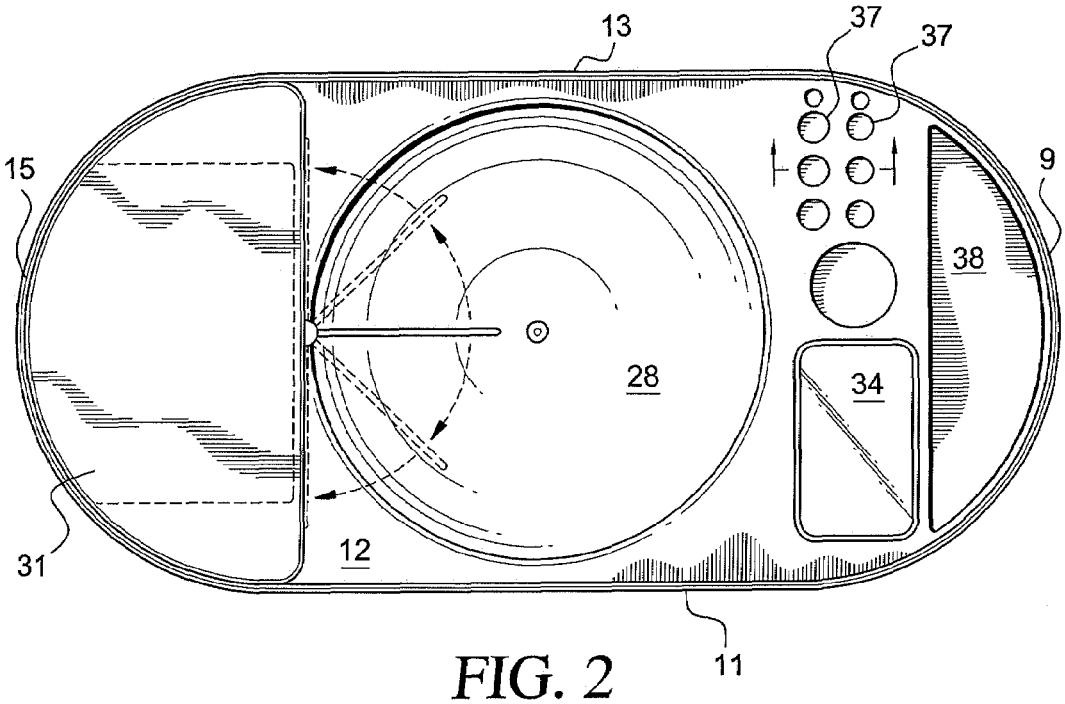
FIG. 2 is a top plane view of a portable sink in accordance with the present invention.
Figure 3:
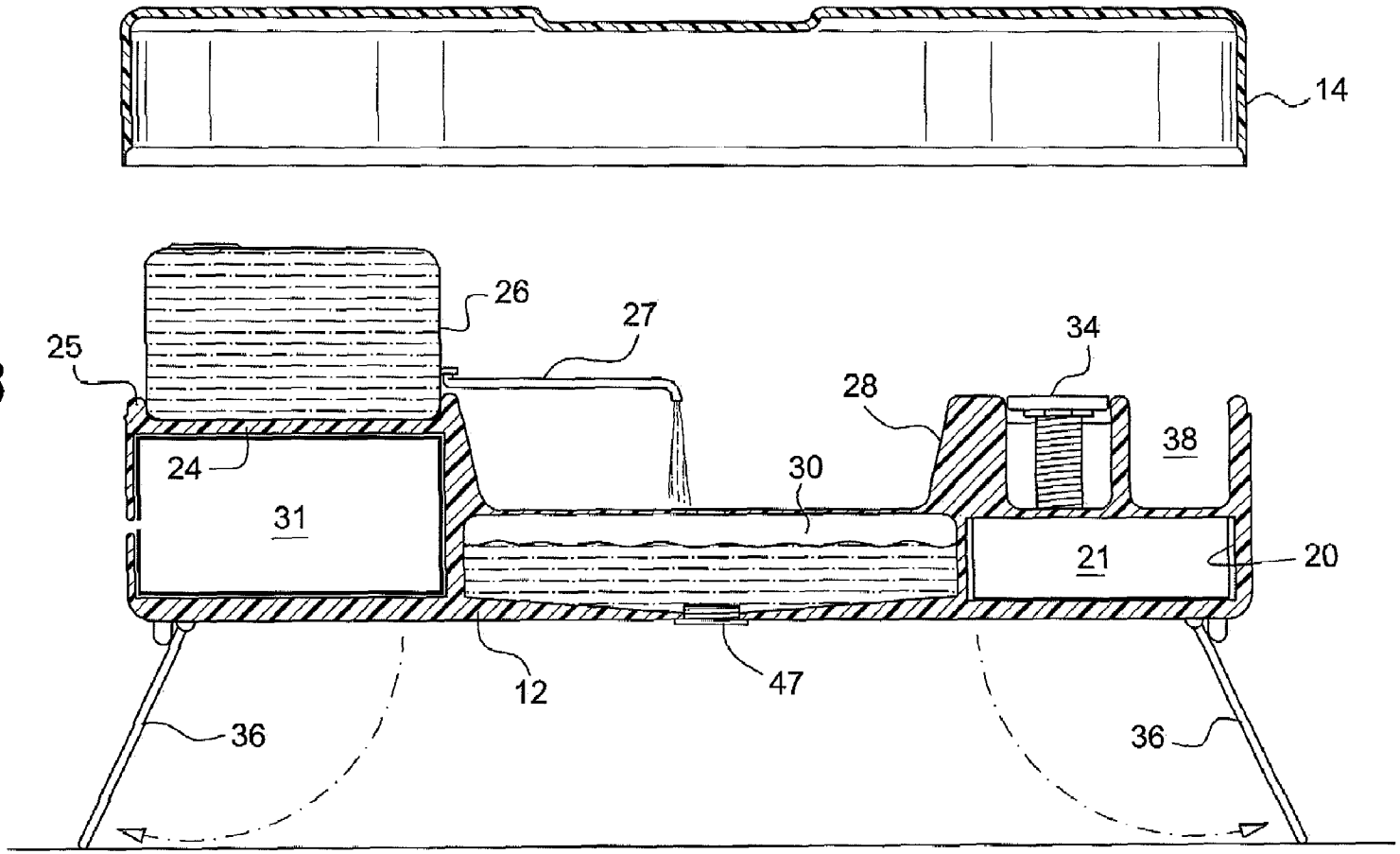
FIG. 3 a cross sectional view taken along the lines 2-2 in FIG. 2.

As shown more clearly in FIGS. 2 and 3 the base member 12 includes a support member 24 or shelf for supporting a clean water tank 26 and a rib 25 that extends around the tank 26 to prevent its lateral movement. In the preferred embodiment of the invention the water tank 26 may be removed from the portable sink assembly 10 and refilled with water, as for example warn water, and then returned and positioned within the rib 25. The water tank 26 also includes an extension or faucet 27 that extends out over the concave basin 28 and can be moved back against the tank 26 to cut off the flow of water from the clean water tank when it is pivoted back into contact with the basin 28. Pushing the faucet back against the tank 26 not only shuts off the flow of water but provides an unobstructed access to the basin and avoids the possibility of inadvertently turning the water on when washing ones hands.

Figure 4:
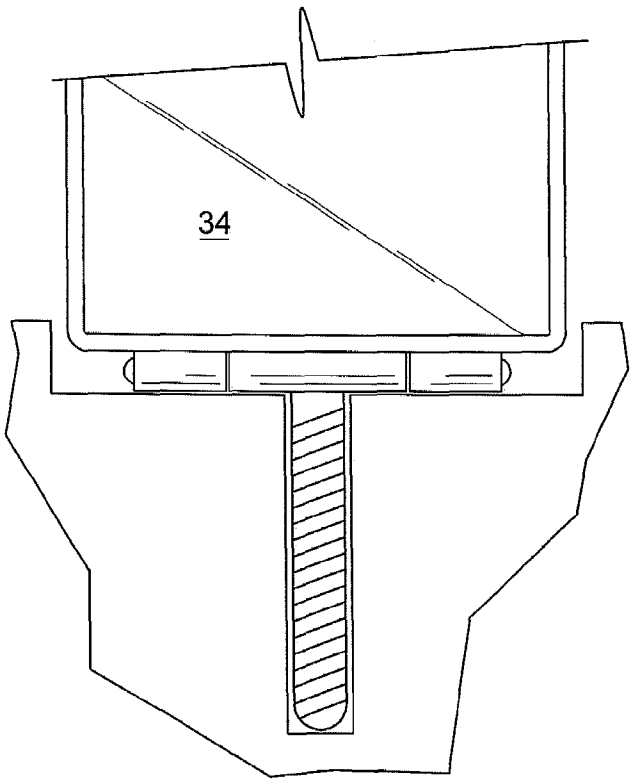
FIG. 4 is a cross sectional view illustrating a mirror assembly incorporated in the resent invention.

A second storage tank 30 for dirty water is disposed in the lower part of the base member 12 directly under the basin 28 and between the drawer 21 and a second drawer 31. The second tank 30 also includes a threaded opening and plug assembly 33 for dumping dirty water. Also as shown in FIGS. 2 and 3 a mirror 34 is mounted in the base member 12 adjacent to the basin 28. The mirror is rotatable into an upright position for use by an individual. A more detailed description of the mirror assemble is contained herein with reference to FIG. 4.

The portable sink 10 also includes a pair of U-shaped support members or legs 36 for supporting the portable sink above a surface. The legs may be of any conventional form but are preferably U-shaped. The upper surface of the base member 12 also includes a recess or pocket 38 above the drawer 21 for holding odds and ends such as a wrist watch or rings. Additional openings 37 may also be provided for a toothbrush, razor, etc. A further indented portion 39 may for example hold a small cup or the like for rinsing an individual's mouth or for taking medication.

Figure 5:
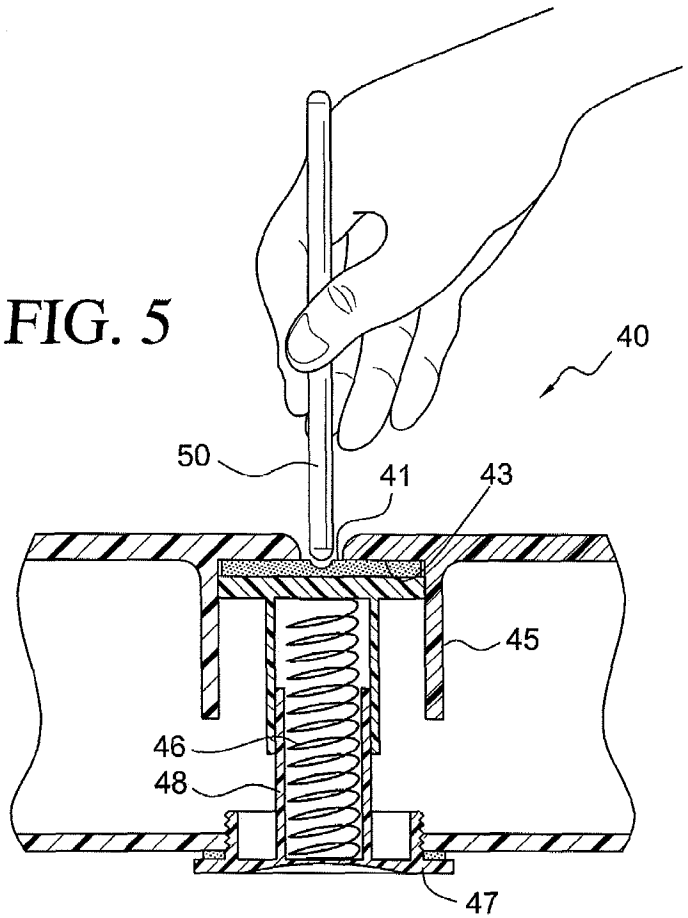
FIG. 5 is a cross sectional view illustrating the depressible valve assembly and depressor.
Figure 6:
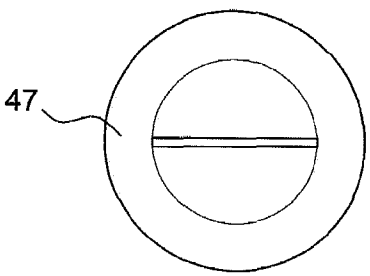
FIG. 6 is a plan view of the plug shown in FIG. 5.

An important element in the present invention resides in a normally closed depressible valve assembly 40 as shown more clearly in FIG. 5. The valve assembly 40 includes an elastomer sealant 41 that extends around a peripheral edge of a circular valve body 42. The valve body 42 engages a seat 43 to prevent water from running out of the basin. The valve assembly 40 also includes a cylindrically downwardly extending skirt 45 that acts as a valve guide for the valve body 42. The valve 40 also includes a coil spring 46 disposed within the skirt 45 for biasing the valve body into engagement with the seat 43 to prevent water from running out of the basin 28 and into the storage tank 30. The coil spring 46 also engages a threaded plug 47 in the bottom of the storage tank 30. A second circular skirt 48 extends upwardly from the plug 47, envelopes the coil spring 46 and fits within the downwardly extending skirt 45.

In a preferred embodiment of the invention, the valve assembly 40 is manually opened by a separate rod like depressor 50. The depressor 50 is hand held and consists of a separate piece that may be attached to the sink by a small chain (not shown) but is free of a mechanism that might be inadvertently opened.

While the invention has been disclosed in connection with its preferred embodiments it should be recognized that changes and modifications may be made therein without departing from the scope of the claims.

What is claimed is:

1. A portable sink assembly comprising:

a base member and a plurality of foldable legs for supporting said base member above a surface when in a first position and foldable flat against said base member for storage or transport;

a first storage tank for containing a supply of clean water;

a concave basin for receiving water from said first storage tank and a second storage tank for receiving dirty water from said concave basin;

said base member including support means for supporting said first storage tank above the level of said concave basin, and means for supporting said second storage tank below the level of said concave basin with a lower part of said concave basin in contact with a top portion of said second storage tank;

a fluid passage between said lower part of said concave basin and an upper part of said second storage tank; and a normally closed depressible valve connecting said lower part of said basin and said second storage tank for preventing water from said second storage tank from flowing back into said concave basin, and a separate depressor constructed and arranged for manually depressing said valve for opening said valve to drain said dirty water from said basin and into said second storage tank; and a cover fitting over said base member and means for releasably fastening said cover to said base member.

2. A portable sink assembly according to claim 1 which includes a faucet means for draining water out of said first storage tank and into said basin and wherein said faucet means extends outwardly from said first storage tank and is rotatable through an arc of about 180° to be flush with one side of said first storage tank to prevent further flow of water through the faucet means.

3. A portable sink assembly according to claim 1 in which said base member includes a water level indicator on one side thereof for indicating the level of water in said second storage tank.

4. A portable sink assembly according to claim 1 in which said cover includes a handle in an upper portion thereof for carrying said portable sink assembly.

5. A portable sink assembly according to claim 1 in which said base member includes a first drawer and drawer opening in a front lower portion thereof adjacent to said second storage tank.

6. A portable sink assembly according to claim 5 in which said base member includes a second drawer and a second drawer opening in a lower side portion thereof under said first storage tank and adjacent to said second storage tank.

7. A portable sink assembly according to claim 1 which includes a foldable mirror adjacent to said concave basin.

8. A portable sink assembly according to claim 1 in which said normally closed depressible valve includes a circular stopper within a cylindrical opening, a downwardly extending circular skirt and a coil spring adapted to bias said circular stopper and circular skirt upwardly against the bottom of said concave basin.

9. A portable sink assembly according to claim 8 in which said second storage tank includes a threaded circular plug in a bottom of said second storage tank and a threaded opening extending through a bottom surface of said base member for emptying and sealing said second storage tank and wherein said circular plug includes a seal around an outer periphery and a upwardly extending skirt surrounding said coil spring and fitting within said downwardly extending skirt when said plug is screwed into said threaded opening.

10. A portable sink assembly consisting of the following combination in:

a base member and a plurality of foldable legs for supporting said base member above a surface when in a first position and foldable flat against said base member for storage or transport;

a first storage tank for containing a supply of clean water;

a concave basin for receiving water from said first storage tank and a second storage tank for receiving dirty water from said concave basin;

said base member including support means for supporting said first storage tank above the level of said concave basin, and means for supporting said second storage tank below the level of said concave basin with a lower part of said concave basin in contact with a top portion of said second storage tank;

a fluid passage between said lower part of said concave basin and the upper part of said second storage tank; and a normally closed depressible valve connecting said lower part of said basin and said second storage tank for preventing water from said second storage tank from flowing back into said concave basin and a separate depressor constructed and arranged for manually depressing said valve for opening said valve to drain dirty water from said basin and into said second storage tank;

a cover fitting over said base member and means for releasably fastening said cover to said base member; and a faucet means for draining water out of said first storage tank and into said basin and wherein said faucet means extends outwardly from said first storage tank and is rotatable through an arc of about 180° to be flush with one side of said first storage tank to close off the flow of water from said first storage tank; and in which said base member includes a water level indicator on one side thereof for indicating the level of water in said second storage tank and in which said cover includes a handle in an upper portion thereof for carrying said portable sink assembly; and said base member further including a first drawer and drawer opening in a front lower portion thereof adjacent to said second storage tank and a second drawer opening in a lower side thereof under said first storage tank and adjacent to said second storage tank and a foldable mirror adjacent to said concave basin wherein said mirror is foldable flat during storage and in general vertical position for use.

11. A portable sink assembly according to claim 10 in which said normally closed valve includes a circular stopper within a cylindrical opening, a downwardly extending circular skirt and a coil spring adapted to bias said circular stopper and circular skirt upwardly against the bottom of said concave basin.

12. A portable sink assembly according to claim 11 in which said second storage tank includes a threaded circular plug in a bottom portion of said storage tank and a threaded opening extending through a bottom surface of said base member for emptying and sealing said second storage tank and wherein said circular plug includes a seal around an outer periphery and an upwardly extending skirt surrounding said coil spring and fitting within said downwardly extending skirt when said plug is screwed into said threaded opening.

* * * * *